US006968814B2

(12) United States Patent
Battlogg

(10) Patent No.: US 6,968,814 B2
(45) Date of Patent: Nov. 29, 2005

(54) DEVICE FOR CONVERTING A ROTATIONAL MOVEMENT INTO A RECIPROCATING MOVEMENT

(76) Inventor: Stefan Battlogg, Haus Nr. 166, St. Anton/Montafon (AT) A-6771

( * ) Notice: Subject to any disclaimer, the term of this patent is extended or adjusted under 35 U.S.C. 154(b) by 0 days.

(21) Appl. No.: 10/949,913

(22) Filed: Sep. 24, 2004

(65) Prior Publication Data

US 2005/0092274 A1 May 5, 2005

Related U.S. Application Data

(63) Continuation of application No. PCT/AT03/00050, filed on Feb. 17, 2003, and a continuation of application No. PCT/AT02/00096, filed on Mar. 28, 2002, and a continuation of application No. 10/213,625, filed on Aug. 6, 2002, now Pat. No. 6,802,287.

(30) Foreign Application Priority Data

Nov. 15, 2002 (AT) ..... A 1728/2002

(51) Int. Cl.[7] ..... F01L 1/34
(52) U.S. Cl. ..... 123/90.16; 123/90.15; 123/90.18; 123/90.39; 123/90.6; 74/53
(58) Field of Search ..... 123/90.15–90.18, 123/90.2–90.27, 90.31, 90.6, 90.39–90.47; 74/53–55, 74/569, 567

(56) References Cited

U.S. PATENT DOCUMENTS

| | | | | |
|---|---|---|---|---|
| 1,937,152 | A | | 11/1933 | Jünk |
| 2,858,818 | A | | 11/1958 | Bailey |
| 2,888,837 | A | | 6/1959 | Hellmann |
| 2,954,017 | A | | 9/1960 | Forstner |
| 4,200,081 | A | | 4/1980 | Meyer et al. |
| 4,598,947 | A | * | 7/1986 | Fourrey et al. ..... 297/362 |
| 4,711,202 | A | | 12/1987 | Baker |
| 5,297,508 | A | | 3/1994 | Clarke et al. |
| 5,477,746 | A | * | 12/1995 | Perisho et al. ..... 74/512 |
| 5,505,168 | A | | 4/1996 | Nagai et al. |
| 5,931,130 | A | | 8/1999 | Lucarini |
| 6,705,262 | B2 | | 3/2004 | Battlogg |
| 2002/0073947 | A1 | | 6/2002 | Battlogg |
| 2002/0073948 | A1 | | 6/2002 | Battlogg |
| 2002/0185092 | A1 | | 12/2002 | Battlogg |
| 2004/0094108 | A1 | | 5/2004 | Battlogg |
| 2004/0154567 | A1 | | 8/2004 | Battlogg |

FOREIGN PATENT DOCUMENTS

| | | |
|---|---|---|
| DE | 37 00 715 A1 | 7/1987 |
| DE | 37 05 128 A1 | 9/1988 |

(Continued)

*Primary Examiner*—Thomas Denion
*Assistant Examiner*—Jaime Corrigan
(74) *Attorney, Agent, or Firm*—Laurence A. Greenberg; Werner H. Stemer; Ralph E. Locher

(57) ABSTRACT

The invention relates to a device for converting a rotational displacement into a displacement back and forth. Said device comprises at least one control cam region, provided with a driven cam element, having an eccentric control surface, and a cam follower element that can be displaced or pivoted by the cam element. The cam element is rotatably mounted in a flexible encircling element which is displaceably connected to the cam follower element on a plane that is perpendicular to the rotational axis of the cam element. The encircling length of the flexible encircling element and the peripheral length of the control cam region are configured to correspond and can be modified.

37 Claims, 11 Drawing Sheets

FOREIGN PATENT DOCUMENTS

| | | | |
|---|---|---|---|
| DE | 100 53 776 | A1 | 7/2001 |
| EP | 0 429 277 | A1 | 5/1991 |
| FR | 2 817 908 | | 6/2002 |
| FR | 2 817 908 | A1 | 6/2002 |
| GB | 434247 | | 8/1935 |
| GB | 741831 | | 12/1955 |
| GB | 2 066 403 | A | 7/1981 |
| WO | 98/26161 | | 6/1998 |
| WO | 01/12958 | | 2/2001 |
| WO | 01/12958 | A1 | 2/2001 |
| WO | 01/12959 | | 2/2001 |
| WO | 03/014535 | A1 | 2/2003 |

* cited by examiner

DEVICE FOR CONVERTING A ROTATIONAL MOVEMENT INTO A RECIPROCATING MOVEMENT

CROSS-REFERENCE TO RELATED APPLICATIONS

This application is a continuation, under 35 U.S.C. §120, of international applications PCT/AT03/00050, filed Feb. 17, 2003, and PCT/AT02/00096, filed Mar. 28, 2002, and of copending patent application Ser. No. 10/213,625, filed Aug. 6, 2002; the application further claims the foreign priority, under 35 U.S.C. §119, of Austrian patent application AT 1728/2002, filed Nov. 15, 2002.

BACKGROUND OF THE INVENTION

FIELD OF THE INVENTION

The invention relates to a device for converting a rotational movement into a reciprocating movement, in particular cam control, valve timing gear for internal combustion engines of motor vehicles or the like, having a support shaft and having at least one control cam region, in each control cam region a rotatably driven cam element having an eccentric control surface and a cam follower element which can be displaced or pivoted by the cam element, in particular a valve tappet or the like, being provided, the cam element being arranged rotatably in a flexible enclosing element which is connected to the cam follower element.

One essential sphere of use for devices of this type is in the construction of internal combustion engines, in particular for motor vehicles. Since customary valves of internal combustion engines require for their closing restoring springs which have to apply considerable forces, constrained guides which require weaker restoring springs or render them unnecessary have also already been proposed. Particular embodiments of a constrained guide of this type can be gathered, for example, from DE 37 00 715 A or FR 28 17 908 A, in which the cam element is surrounded in each case in a loosely fitting manner by a flexible enclosing element which is connected to the valve actuating element. The cam element therefore revolves in the enclosing element.

Different variants of this type of constrained guide are described in WO 01/12958 A and WO 01/12959 A. The enclosing element surrounds the circumference of the cam element without significant play, and so it is matched to the shape of the cam; and the cam element can rotate in the enclosing element on account of the structure of the latter. Since the enclosing element, which is connected to the valve adjusting element, cannot rotate together with the cam element, the migration of the cam region about the axis of rotation of the cam element is converted into a lifting or reciprocating movement of the cam follower element, which is mounted displaceably or pivotably in the cylinder head. The cam follower element does not execute any movement as long as the region in which the enclosing element is connected to the cam follower element rests on the base circle region of the rotating cam element, and is then moved away from the axis of rotation of the cam element in the radial direction and finally is returned again, while the cam region of the cam element moves past the region in which the enclosing element is connected to the cam follower element.

A multiplicity of different constructions have been disclosed under the term "variable valve control", by means of which the opening and the closing time and also the stroke of the valve can be changed in order to improve the power, the exhaust behavior, the fuel consumption, the torque, etc. of an internal combustion engine. In comparison to a non-adjustable valve control with fixed values, the filling of a cylinder is improved if the valve is opened later and closed earlier at low rotational speeds and is opened earlier and closed later at higher rotational speeds, and if the stroke is varied. It is therefore possible, by means of adjusting the valve control as a function in particular of load and/or rotational speed, to optimize the exhaust behavior, the torque, the engine power, etc. The variable valve controls usually change the position of the actuating surface of the cam follower element relative to the eccentric valve control surface or to the axis of the support shaft (WO 98/26161) by rotation, displacement or enlargement of the cam element.

In the case of the constrained guides which are mentioned at the beginning and in which the cam element is surrounded in a manner essentially free from play by a flexible enclosing element and the enclosing element is connected to the cam follower element, a variable control by rotation, displacement or enlargement of the enclosed cam element is not possible.

WO 01/12959 which has been mentioned has already described a type of variable control, the enclosing element exclusively being changeable in a reversible manner there. The non-changeable, rotating cam element produces tensile forces, which rise as a function of the rotational speed, at the point of connection to the cam follower element, with the result that the enclosing element, which bears against the circumference of the cam element in a manner free from play at a low rotational speed, lifts off further and further from the circumference as the rotational speed rises, and, as a result, adopts positions which correspond to cam elements having relatively large circumferential lengths. The stroke of the cam follower element is therefore increased as a function of the rotational speed.

Two possibilities are described: in a first variant, the enclosing element has at least one subregion which is elastic in length to a limited extent and, in the second variant, the enclosing element is not elastic, but is longer than the enclosing element, and the excess length is accommodated in a protuberance, with an elastic change of the size of the protuberance being provided.

SUMMARY OF THE INVENTION

The invention has now set itself the object of, in the case of a device of the type mentioned at the beginning, making a variable control possible despite the enclosing element surrounding the circumference in a manner essentially free from play.

According to the invention, this is achieved by the enclosing length of the enclosing element and the circumferential length of the cam element being changeable in a corresponding manner. In this case, changeable in a corresponding manner is understood to mean that the enclosing element always surrounds the cam element in a manner essentially free from play, with it being insignificant which of the two lengths serves as the correcting variable for the second length. It is possible for both the circumferential length of the cam element to be changeable in a variable manner corresponding to the length of the enclosing element and also for the enclosing length of the enclosing element to be designed in a manner such that it can be matched to the particular circumferential length of the cam element.

The active adjustment of the cam element permits an enlarged adjustment region, since a zero stroke can be selected as the starting point, in which stroke the parts of the cam element are joined to one another within a circular circumferential contour. The zero stroke is of importance, for example, if it is intended to be possible to be able to take individual valves of an internal combustion engine out of operation.

The cam element can preferably move on the support shaft out and in in a radial plane without changing a part which surrounds the normal-position bearing surface of the control cam region.

In one variant, the part which surrounds the normal-position bearing surface is provided on the support shaft and rotates together with the latter. The support shaft is hollow and accommodates a control shaft on which a control surface, which brings about at least the pushing-out of the cam element, is provided in the control cam region.

In a first variant, the control shaft can be displaced longitudinally in the support shaft and can have an oblique surface which interacts with a corresponding oblique surface on the cam element. In a further variant, the control shaft can be arranged in a rotatable manner in the support shaft and can have a spiral control surface which interacts with an inwardly protruding web or the like of the cam element.

A third variant, in which the control shaft can likewise be rotated in the support shaft, makes provision for the cam element to be arranged in a manner such that it can pivot about an axis parallel to the axis of rotation of the support shaft and to be provided with a guide surface which interacts with a crank pin of the control shaft. If the cam element is pivoted, an asymmetrical change in the cam profile takes place. Different opening and closing properties are additionally produced in the case of a valve timing gear.

The support shaft may itself be used as a control shaft if it is arranged in a longitudinally displaceable manner in at least two bearing elements and has an oblique surface which interacts with an oblique surface of the cam element, the cam element being held, for example by the two bearing elements, in a manner such that it cannot be displaced axially.

In all of the previously described cases, the movement of the cam element taking place in the radial plane may also be guided in a constrained manner, with the result that the cam element is retracted again into the support shaft by the actuating mechanism.

The frictional ratios can be substantially improved if the support shaft and the cam element have channels for feeding a friction-reducing medium to the eccentric control surface.

In a preferred, first variant, an enclosing element which can be changed in the enclosing length is formed from an extension-resistant material and has a circumferential length corresponding to the maximum circumferential length of the cam element, the difference between the enclosing length and the circumferential length of the enclosing element being arranged in at least one variable inward protrusion or protuberance. The formation of a variable inward protrusion or protuberance is possible, since the enclosing element is prevented from rotating on account of its connection to the cam follower element, and so the inward protrusion or protuberance can be provided in a stationary manner at each suitable point, in terms of clearance, around or in the cam element. The inward protrusion or protuberance can be elastically flexible, and in particular can be acted upon by a spring or the like, or can be acted upon in an adjustable manner by means of a hydraulic element or the like.

In a further variant, provision can be made for the protuberance to be provided with an elastically flexible constriction.

During each enlargement of the cam circumference, which brings about a change in the valve stroke, part of the length of the enclosing element that is deposited or stored in the variant is removed, and during each reduction in size, is returned back into the protuberance, so that the enclosing length is always matched to the length of the cam circumference.

In a further variant, the enclosing element can have parts of different materials, at least one material being elastically extensible. The extensible parts render the protuberance, which is provided in the case of extension-resistant materials, superfluous.

One preferred variant of an extension-resistant enclosing element or of a combination of extension-resistant and extensible parts is realized by means of a multi-link element, in particular by means of a chain which has lateral plates connected by pivot pins and, if appropriate, rollers.

In an extension-resistant chain, provision is preferably made for the spring bringing about the protuberance to act between two non-consecutive pivot pins of the chain, with a pivot pin situated in-between being skipped. If the spring is a tension spring, then the pivot pin situated in-between is pressed upward by the cam circumference and forms the protuberance, the plates being raised obliquely on both sides.

A further variant makes provision for the spring to be formed by a spring sheet-metal strip which is guided over the pivot pin which has been skipped and engages with its ends under the two pivot pins. Two protuberances are formed here, since each of the two pivot pins which are engaged under are pressed up by the cam circumference.

In an extendable chain, the plates are elastically flexible and are preferably shaped from a spring wire, plastic, rubber or the like to form a frame-like element which encloses two pivot pins and is prestressed with the effect of shortening the distance between the pivot pins. The plate is therefore stretched when the length of the cam circumference is enlarged, and shortened when it is reduced in size. The difference in length which can be obtained is small if each plate of the closed chain is of elastically flexible design.

If the plates are not formed from resilient material, a compression spring element, for example of rubber, can spread the mutually opposite sides in each plate apart, thus providing the change in length of the plates even in the case of a flexible, non-elastic material.

The stretched position can in each case constitute an extension limit, so that the maximum stroke length is not exceeded, even if rotational-speed-induced additional tensile forces from the cam follower element, which is coupled to the enclosing element, become effective.

In a further variant, provision is made for the enclosing element to consist of an elastically extensible material, an extension limit preferably also being assigned to this enclosing element. For example, the enclosing element may be a band of a textile-bonded surface material, in particular a woven fabric or the like which is produced in a circular working technique and is extensible, with threads which are woven in or are additionally extension-resistant and the length of which corresponds to the length of the maximum cam circumference being provided.

If the band consists of extension-resistant threads or fibers, then the difference in length, as mentioned at the beginning, is stored in at least one spring-actuated protuberance.

Since the enclosing element is exposed by the reciprocating cam follower element in particular to relatively high tensile forces when the push-off acceleration is braked, that part of the enclosing element which lies opposite the connecting region is pressed fixedly onto the circumference of the cam element. Conversely, that part of the enclosing element which includes the connecting region is exposed to correspondingly high compressive forces shortly before it returns into the starting position, since the restoring acceleration is braked, and said part is pressed onto the circumference of the cam element. In both cases, outlet openings situated in these regions are tightly closed by the enclosing element, and a very high pressure would be required in order to feed in the lubricating medium. For example, in conventional cylinder heads there is a pressure of 2 to 5 bar, and at least 10 times the pressure would have to be applied in order to press the enclosing element away from the circumference and to let the medium emerge. (The values of this example refer to oil lubrications). Only partial lubricant films are produced, and a mixed friction occurs, the coefficient of friction of which is not smaller than 0.1.

Since the flexible enclosing element is prevented from rotating, in a further variant, the frictional ratios can be improved once again if the flexible enclosing element surrounds the eccentric control surface of the driven cam element and a non-driven normal-position bearing surface for the cam follower element. A non-driven bearing surface is understood in particular to mean a cylindrical bearing surface which is fixed on the device, for example on a bearing element of the support shaft. This makes it possible, depending on the shape of the cam, to reduce the contact surface, which produces a substantial part of the friction, between the cam element and the enclosing element in length by at least one third, and, in the case of conventional shapes of cam, even by up to two thirds. Since the cam element is additionally also narrower than the enclosing element—an in particular annular end region of a bearing element adjoins the cam element axially at least on one side, preferably on both sides—the contact surface producing the friction is also narrower than in the variants mentioned at the beginning.

However, the non-driven bearing surface may also be formed on a ring or the like mounted rotatably, for example, on the bearing element, so that a minimal rotation to and fro of the bearing surface is possible, said rotation arising because of the slightly alternating and changing geometrical ratios between the point at which the enclosing element is connected to the cam element and the migrating control surface.

Further friction-reducing measures may include the arrangement of rolling bearings between each bearing element and the support shaft and/or the cam element, and/or the arrangement of a rotatably mounted roller in the eccentric control surface of the cam element and/or the formation of channels for feeding a friction-reducing medium, in particular lubricating oil, to contact surfaces producing the friction.

In the abovementioned cases in which high tensile or compressive forces occur, said forces are transmitted directly to the bearing elements by means of the design according to the invention, with the result that the sliding or rolling bearings between the bearing elements and the support shaft are relieved of load. To relieve the mounting of the cam follower element from load, in a further preferred variant, provision is made for that end of the cam follower element which is connected to the enclosing element to be guided in a guide fixed on the device.

The reduction in size of the friction-producing contact surfaces furthermore reduces the quantity of heat which is produced and the removal thereof is facilitated if the vertical base circle region is part of the camshaft bearing and can be connected directly to the housing, in particular the cylinder head, and reduces the need for lubricant.

A small restoring force acting on the cam follower element may be advantageous. In one preferred variant, in which the cam follower element is coupled to the enclosing element by means of a bearing pin, the restoring force can act on the bearing pin by the bearing pin being pressed against the bearing surface fixed on the device by means of an elastic element. To produce the restoring force, use can be made, for example, of a leg spring or the like which is supported at one end on the bearing pin and at the other end on the bearing element or the like. One preferred variant makes provision for the bearing pin to have at least one exposed end region, and for an elastically flexible band of steel, rubber or the like to be guided around the exposed end region and the bearing element.

The invention is described in greater detail below with reference to the figures of the attached drawings, in which:

DESCRIPTION OF THE PREFERRED EMBODIMENTS

Figure 1:
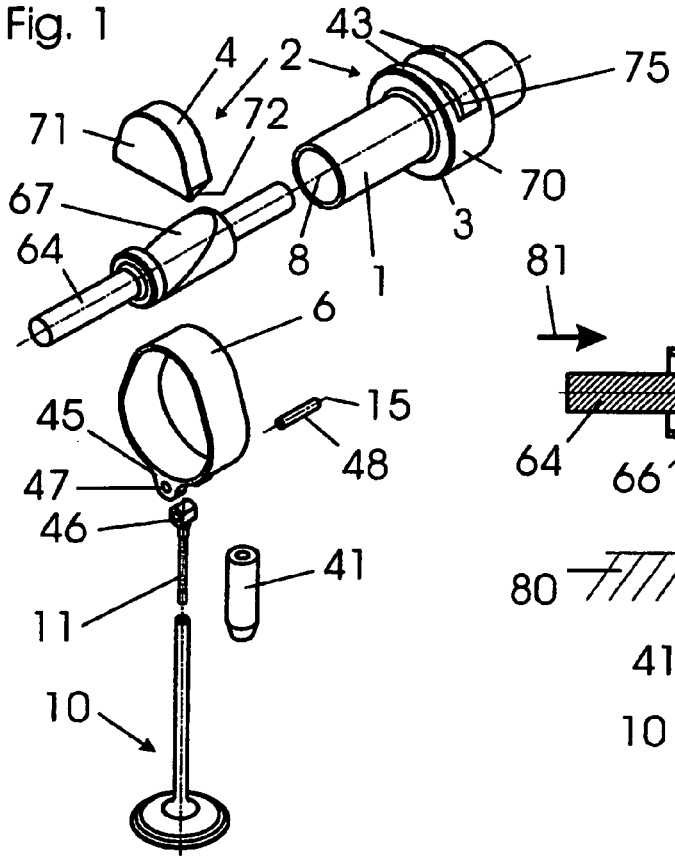
FIG. 1 shows a perspective view of parts of a first variant of a valve timing gear.

A device according to the invention for converting a rotational movement into a reciprocating, rectilinear or pivoting movement comprises a driven support shaft 1 on which in each control cam region 2 a cam element 71 having an eccentric control surface 4 is fixed in a manner not shown specifically. The eccentric control surface 4 enables a cam follower element 10, which is held in a manner bearing against it, to move to and fro in accordance with its guide or mounting. In all of the exemplary embodiments, the preferred use of the device is shown, namely as a valve control of internal combustion engines. However, such devices may also be used, for example, in cam controls of machine tools, in special gears or the like, the cam follower element 10, which forms a valve tappet in the exemplary embodiments shown, being designed in accordance with the use.

The drawings each show just one valve timing gear for a valve, a valve timing gear which is used for an internal combustion engine of a motor vehicle having, on a driven support shaft 1, the number of cam elements 71 required for the valves.

Each control cam region 2 comprises a base circle surface 3, 53 and an eccentric end surface 4 which is provided on a cam element 71 and is surrounded by an essentially adjacent enclosing element 6, so that the cam element 71 can be driven in the enclosing element 6 around the axis of rotation 8 with continuous, pulsating deformation of the enclosing element 6. The cross-sectional shape of the enclosing element 6 is illustrated in the figures in a manner matched in each case to the cam element 71, since the valve time gear here is shown in an exploded illustration, whereas it has the shape of a collapsed oval or the like and it is in the form of a loose individual element. The enclosing element 6 is prevented from rotating by the connection to a cam follower element 10 which, in the case of a valve tappet, is mounted in a manner such that it can be displaced in a guide sleeve 41 of the cylinder block 80 and, in the event of a tilting or drag lever, is mounted pivotably in a pivot bearing. The enclosing element 6 is connected to the cam follower element 10 in a manner such that it can tilt or pivot about an axis 15, so that, during the passage of the cam element 71 through the connecting region of the cam follower element 10, a pivoting of the enclosing element 6 relative to the cam follower element 10 is made possible. This is necessary, since the guide sleeve 41 of the valve stem 11 does not permit any lateral deflection of the valve stem 11, and the valve stem 11 has to be aligned radially with the axis of rotation 8. The rotation of the cam element 71 leads to an oscillating movement of the enclosing element 6 which, however, owing to its connection to the cam follower element 10, cannot rotate, but rather, while the cam element 71 is rotating continuously, is raised from the base circle surface 3. In the process, the cam follower element 10 is transferred from bearing against the base circle surface 3, in which it is at the shortest distance from the axis of rotation 8, into a position the maximum distance away from the axis of rotation 8 when the greatest amount of the eccentric control surface 4 of the cam element 71 is effective, and, on further rotation, is drawn back into the normal position again. In the tappet valves shown, this up and down movement constitutes the valve stroke, the length of the stroke being settable in particular as a function of the rotational speed and/or load, as explained further below.

In all of the variants, the guide sleeve 41 and the valve stem 11 are illustrated in a radial alignment with the axis of rotation 8. However, a lateral offset, from which a distance results between the axis of rotation 8 and the axis of the guide sleeve 41, is readily possible. A variant of this type has opening and closing properties which are asymmetrical in relation to a symmetrical cam element 71, which may be advantageous in certain uses.

In order, in spite of the constrained control, to achieve an enlargement of the valve stroke, in particular as a function of the rotational speed, the enclosing element 6 can either be prestressed to be elastically extensible and to contract, or can have a maximum circumferential length, the particular excess, in the case of a small valve stroke, being stored in a "store", for example in the form of a protuberance.

An elastically extensible enclosing element 6 may be, for example, a band which is produced in a textile circular working technique and which is preferably assigned an extension limit by threads of fibers consisting of Kevlar, glass, carbon, high modulus polyethylene, polyester, boron or aramid or similar fibers which are essentially constant in length, or combinations of these fibers, which threads extend in the circumferential direction of the cam element, being provided in the extensible material or parallel to it. The elastic extension may be selected to be linear, progressive or degressive by, for example, threads having different extension properties which are effective at the same time or one after another being incorporated. Particularly suitable materials for an enclosing element having at least elastically extensible subregions have a modulus of elasticity of between 1 and 4,000 $N/mm^2$. Gummy materials have low moduli of elasticity and are preferably provided with an extension limit. Materials, such as plastics, having higher moduli of elasticity, in particular between 600 and 2000 $N/mm^2$, preferably between 800 and 1200 $N/mm^2$, generally do not need any extension limit but one may, of course, be provided.

Figure 2:
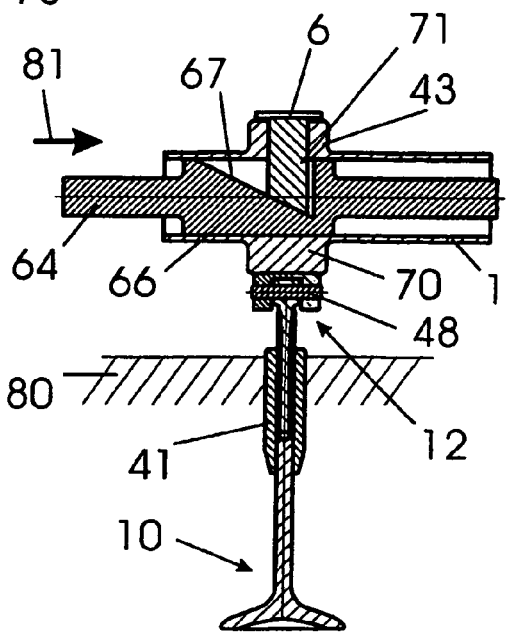
FIGS. 2 to 4 show longitudinal sections through the first variant, FIG. 2 showing a zero stroke position, FIG. 3 showing a normal stroke position and FIG. 4 showing a maximum stroke position.
Figure 3:
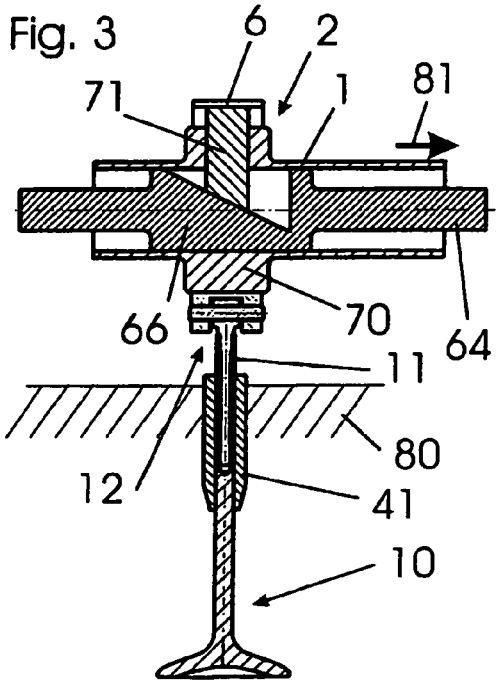
Figure 4:
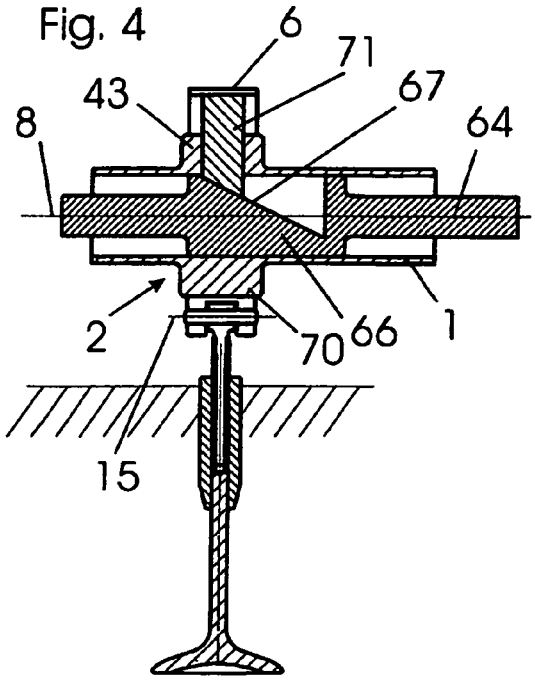

In FIGS. 1 to 14, the enclosing element 6 is formed by an elastic band of this type. The control cam region 2 comprises a cam part 70 which is connected in a rotationally fixed manner to the support shaft 1, and a cam element 71. The cam part 70 has a cylindrical basic shape with the base circle surface 3 and a central aperture 75 comprising less than half of the circumference, with two cam regions 43 having a circular outer contour remaining on both sides. According to FIGS. 1 to 4, a control rod 64 which rotates at the same time as the support shaft 1 can be displaced axially therein and has, in the region of each cam element 71, a control section 66 having an axially rising oblique surface 67. The cam element 71 of the cam element 2 bears against the oblique surface 67, which is exposed in the aperture 75, said cam element likewise having an oblique surface 72 and the eccentric control surface 4 is provided on it and it is guided between the lateral cam regions 43 in the aperture 75. FIGS. 2 to 4 show various positions. In FIG. 2, the control rod 64 is displaced so far to the left that the cam element 71 reaches its deepest position in which it lies within the circular outer contour of the cam part 70. In this position, the rotation of the cam element 71 also does not cause a valve stroke. The cam follower element 10, which is guided in the guide sleeve 41 of the cylinder block 80 or the like, remains in the closed position, and the enclosing element 6 is not extended. An associated cylinder of the internal combustion engine is therefore not in operation.

If the control rod 64 is displaced to the right (arrow 81) by an actuating mechanism (not shown), then, in a position according to FIG. 3, a normal stroke position is provided, as is favorable, for example, for the idling speed or low rotation speed range, with the cam element 71 having being pushed out radially. The enclosing element 6, which is elastic in this variant, is extended by a certain extent in the direction of the valve stem 11 partly by the cam element 71 being pushed out and partly by the tensile forces, which are also in effect in the idling speed, the increase in distance between the axis rotation 8 and the holder 12 corresponding to the pushing-out of the cam element 71. Without an expansion of the enclosing element 6 that is brought about actively by the displacement of the control rod 64, the transition from the zero stroke position of FIG. 2 into the normal stroke position according to FIG. 3 is not possible, since the cam follower element 10, which is at rest in FIG. 2, does not exert on the enclosing element 6 any tensile forces resulting from the rotation of the support shaft 1. A further displacement of the control rod 64 in the direction of the arrow 81 transfers the cam element 71 into the maximum stroke position of FIG. 4, in which the uppermost region of the oblique surface 76 is reached. The enclosing element 6 is extended to its maximum length and contracts again when the control rod 64 is displaced back.

Figure 5:
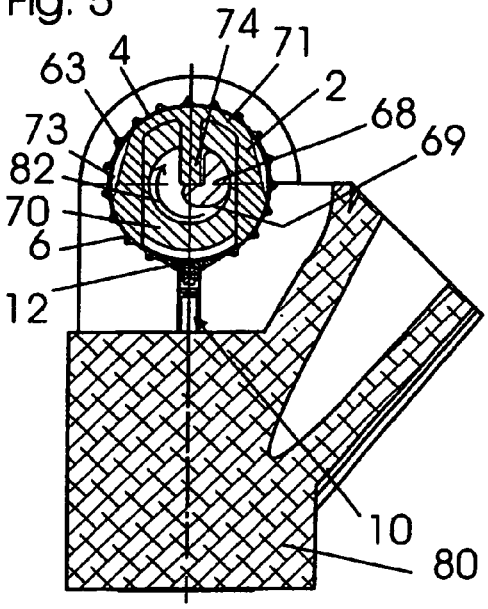
FIGS. 5 and 6 show the zero stroke and maximum stroke position of a second variant.
Figure 6:
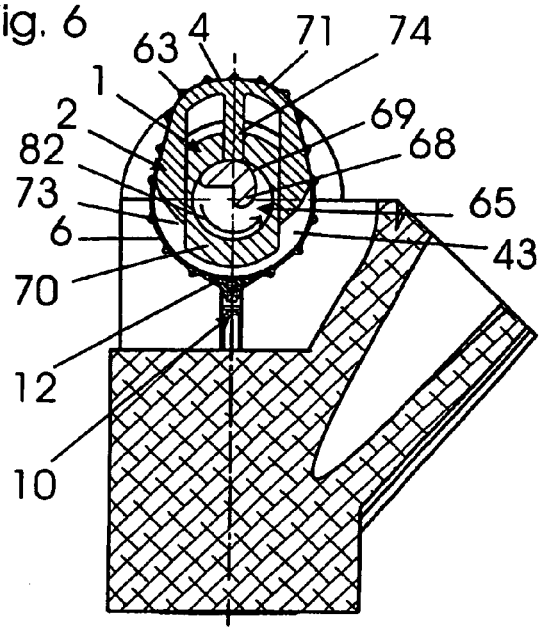

In the variant according to FIGS. 5 and 6, a rotatable control shaft 65 is provided for the radial movement of the cam element 71 in the support shaft 1, the control region of which control shaft is formed by a crank-pin-like element 68 having an eccentric control surface 69 rising spirally. The sequence of adjustment of the cam element 71, when the control shaft 65 is rotated in the direction of the arrow 82, can be seen from comparing the two FIGS. 5 and 6. In the pushed-out position according to FIG. 6, the cam element 71 is held by the element 68 of the control shaft 65. If the control shaft 65 is rotated back counterclockwise in the support shaft 1, then the cam element 71, which bears against the spiral control surface 69, migrates inward again until the zero stroke position according to FIG. 5 is reached. In this, the cam element 71 is situated within the cylindrical outer surface of the cam part 70, with the result that the contracted enclosing element 6 fits around the cam part 70.

Owing to the elasticity of the enclosing element 6, it may be advantageous if it contains in the transverse direction, i.e. in the axial direction of the support shaft 1, stiffenings, for example in the form of reinforcing ribs 63, which have, for example, pins inserted or bonded into them. The transverse stiffenings prevent unsupported parts of the enclosing element 6 from being pulled into clearances 73 in the control cam region 2, the clearances arising from the intermeshing of the cam part 70 and the cam element 71.

Figure 7:
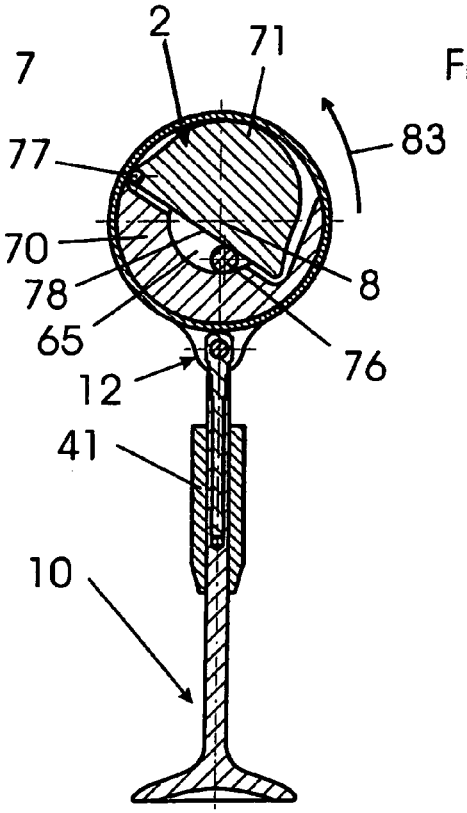
FIGS. 7 and 8 show the zero stroke and maximum stroke position of a third variant.
Figure 8:
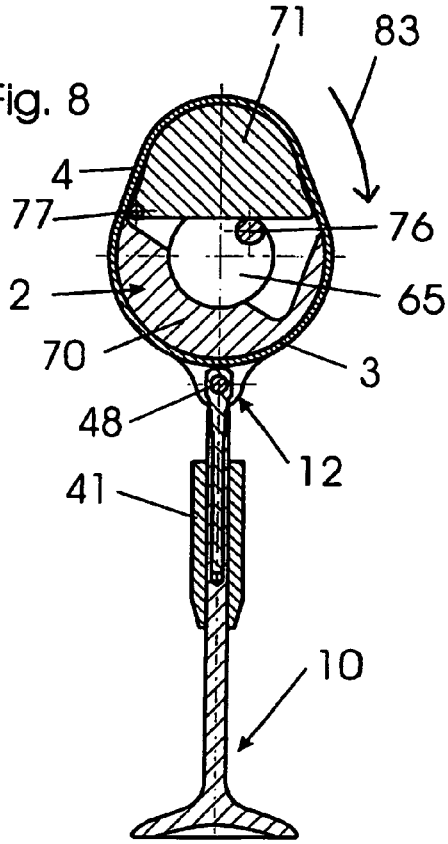

The variants according to FIGS. 7 and 8 show a cam element 71 which bears the eccentric control surface 4 and is mounted on the cam part 70 in a manner such that it can pivot about an axis 77 parallel to the axis of rotation 8. The pivoting takes place via a crank pin 76 of the support shaft 75 which pivots the cam element 71 upwards (arrow 83) from the zero stroke position according to FIG. 7 into the maximum stroke position according to FIG. 8, with the enclosing element 6 being extended. The eccentric control surface 4 of the cam element 71, which surface is situated in FIG. 7 within the circular circumferential contour of the cylindrical cam part 70, gives the control cam region 2 an asymmetrical shape, with the result that there are different opening and closing properties of the valve for each size of the stroke. In this case, selection of the curved shape of the cam element 71 preferably provides a pivoted-out position in which the control cam region 2 is symmetrical (FIG. 8). However, this does not have to be the maximum stroke position.

In the previous variants of FIGS. 1 to 8, the control cam region 2 exclusively comprises elements rotating at the same time about the axis of rotation 8. In the following variants according to FIGS. 9 to 16, not all of the elements rotate about the axis of rotation 8; on the contrary, the base circle region 3 is provided on an element which does not rotate at the same time and which therefore has a fixed normal-position bearing surface 53 for the cam follower element 10.

Figure 9:
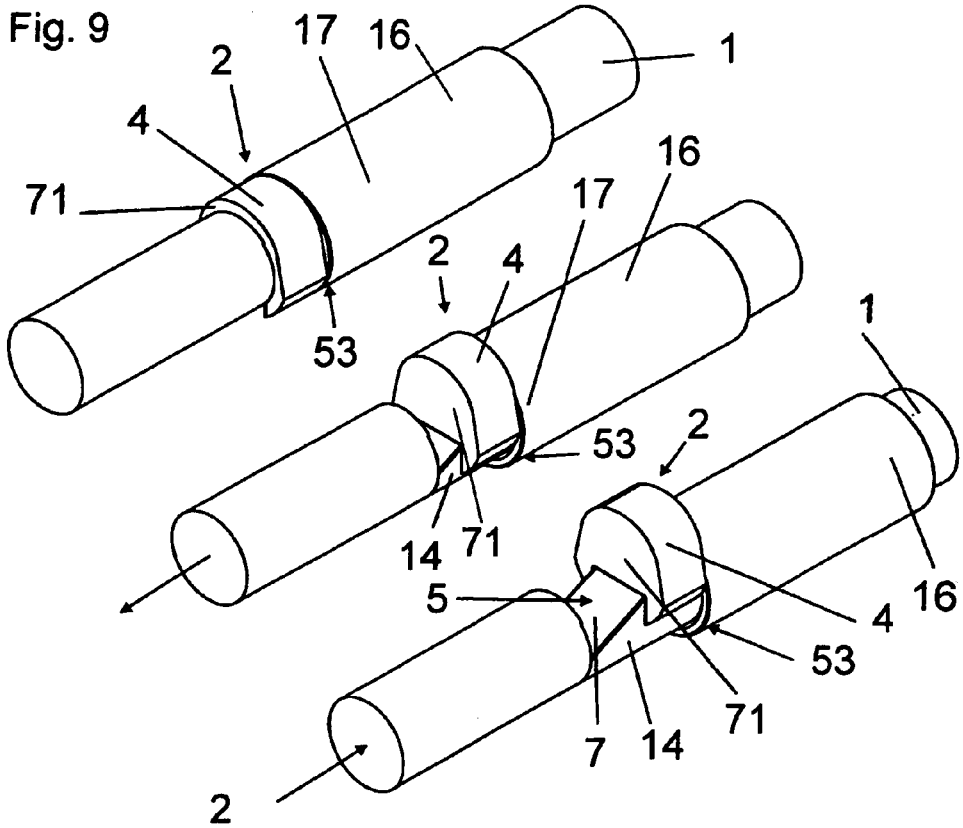
FIG. 9 shows oblique views of the support shaft and of the cam element in three different positions of a fourth variant.
Figure 10:
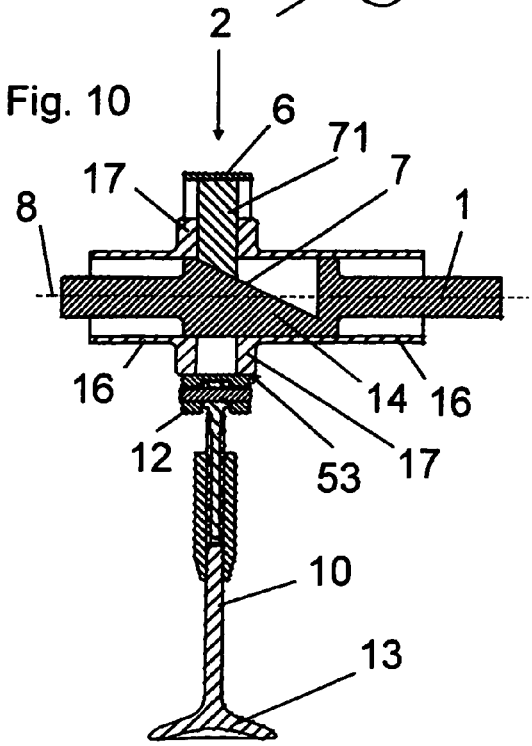
FIG. 10 shows a longitudinal section similar to FIG. 4 through the variant according to FIG. 9, FIGS. 11 and 12 show longitudinal sections through a fifth variant of the device according to the invention, the cam follower element bearing in each case against the bearing surface.

FIGS. 9 and 10 show variants in which the bearing elements 16 are shown as pipe lengths having ring-like end regions 17 which are fixed, for example, in securing means fixed on the housing, or are provided with corresponding fastening parts. The cam element 71 has the eccentric control surface 4 whose axial extent around the two annular end regions 17 of the bearing elements 16 is shorter than the width of the enclosing element 6. The enclosing element 6 therefore surrounds part of the cylindrical circumferential surface of the two end regions 17 and the eccentric control surface 4 of the cam element 71. Since only the eccentric control surface 4 has to slide on the inner surface of the enclosing element 6, the friction-producing contact surface is smaller than half the inner surface of the enclosing element 6. As mentioned, the latter is connected via its holder 12 to the cam follower element 10 in an articulated manner, so that no friction occurs between the enclosing element 6 and the cylindrical outer surface, serving as the bearing surface 53, of the two end regions 17 which, as parts of the bearing elements 16, are fixed on the housing. The axis of articulation 15 runs parallel to the axis of rotation 8 of the support shaft 1. The rotation of the cam element 71 leads in turn to an oscillating movement of the enclosing element 6 which, owing to its connection to the cam follower element 10, is raised continually all the way round by the outer surface of the end region 17. In the process, the cam follower element 10 is transferred by the bearing surface 53, in which the cam follower element 10 is at the shortest distance from the axis of rotation 8 and which forms part of the outer surface of the end region 17, into a position the maximum distance away from the axis of rotation 8 when the maximum extent of the eccentric control surface 4 of the cam element 71 is effective, and, on further rotation, is retracted again into the normal position. In the case of the valve timing gear, the closed position is therefore the normal position and the position the maximum distance away is the open position of the valve disk 13.

Figure 14:
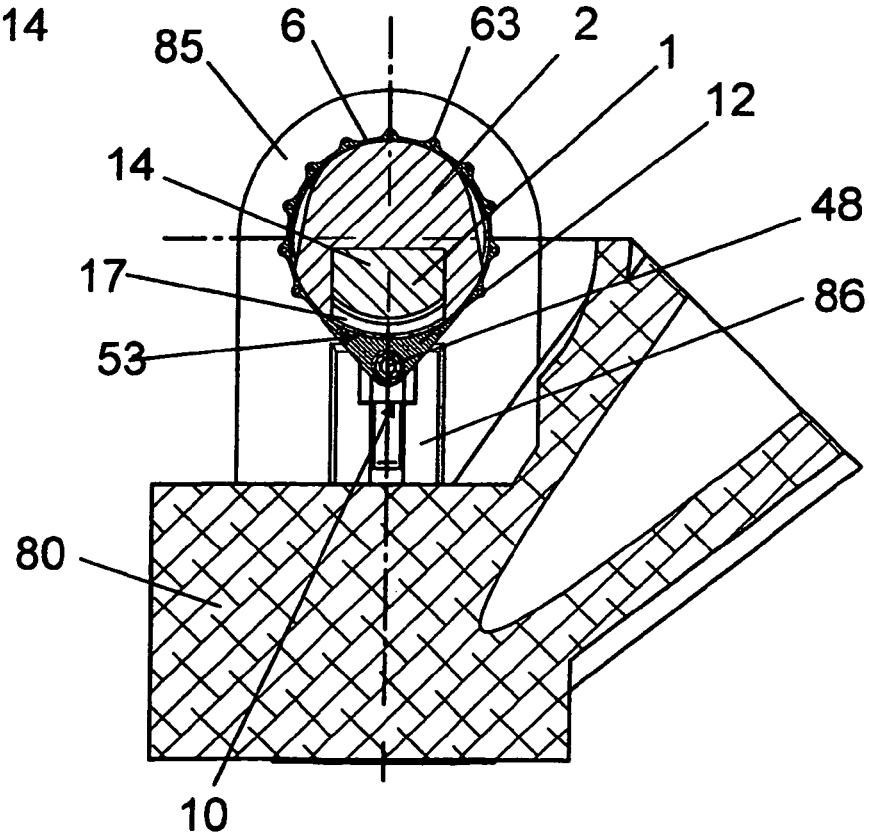

As FIGS. 9 and 14 show, one central, hub-like region 14 of the support shaft 1 is mounted rotatably preferably on both sides in a bearing element 16, per control cam region 2. The region 14 has a cutout 5 which is provided with an oblique surface 7, which rises in the longitudinal direction, and lateral parallel flattened sections. The cam element 71 is provided with an approximately U-shaped cutout on the side lying opposite the eccentric control surface 4 and is guided in a manner such that it can be pushed out and in vertically on the parallel flattened sections.

According to the variant shown in FIGS. 11 to 14, an extended bearing pin 48, on which a cam follower element 10 is mounted rotatably on both sides, is inserted into the holder 12 of the enclosing element 6. The ends 61 of the bearing pin 48 protrude in each case through a slot 87 in securing means 85 and are pressed against the bearing elements 16 by a band of rubber, a clamp of spring steel or another elastic element 31. The element 31 is prevented from slipping laterally by a collar. The elastic elements 31 are extended by the cam element 71 during the downwards movement of the cam follower elements 10, i.e. during the opening of the valves, and produce a force which assists the return and may be advantageous in many uses. Substantially stronger restoring springs engaging directly on the cam follower elements 10 are rendered superfluous by the constrained guidance of the enclosing element 6. Instead of the band shown, other spring devices, for example leg springs, but also piston/cylinder units or the like which can be acted upon, may also be provided. FIG. 14 clearly shows that the cam element 71, which does not protrude in a deepest position over the circumference of the bearing element 16, is raised, when the support shaft 1 is displaced to the left, by the oblique surface 7, which rises in a wedge-shaped manner, and is transferred into the position in which it is extended to the maximum (shown in FIG. 13).

Figure 11:
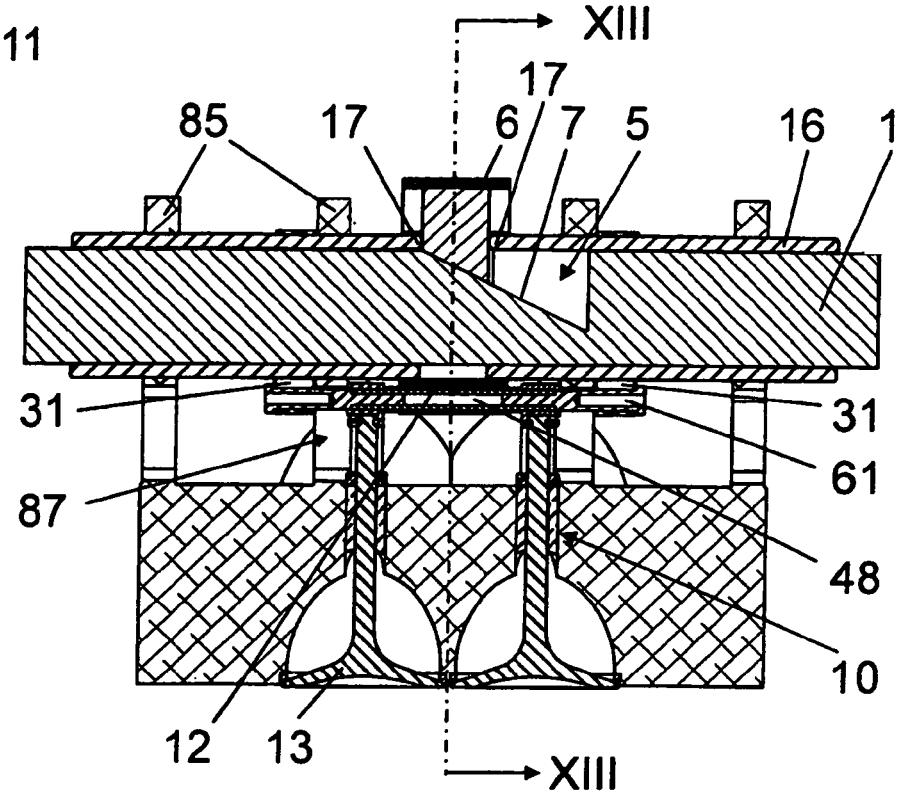
Figure 12:
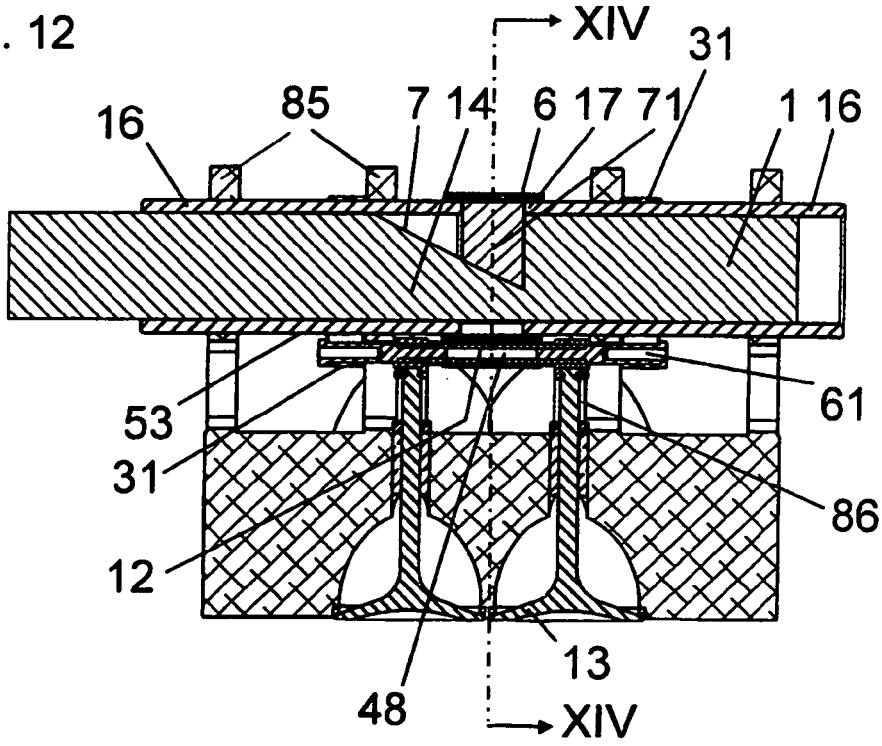
Figure 13:
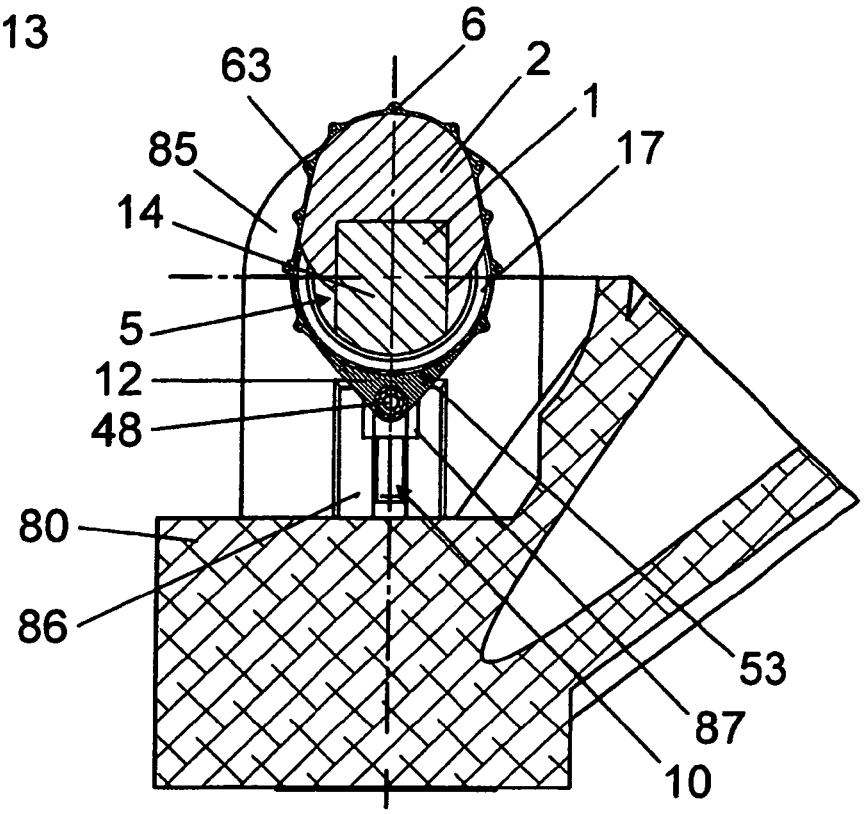
FIGS. 13 and 14 show sections along the line XIII—XIII from FIG. 11 and the line XIV—XIV from FIG. 12, FIGS. 15 and 16 show schematic side views of a sixth variant with a cam element guided in a constrained manner by means of a crank drive, in two different positions.

The elastic enclosing element 6 can make the elastic elements 31, shown in FIGS. 11 and 12, unnecessary, since it likewise exerts a restoring force on the bearing pin 48. Owing to the elasticity of the enclosing element 6, it may be advantageous if, in the transverse direction, i.e. in the axial direction of the support shaft 1, it contains stiffenings, for example in the form of reinforcing ribs 63, which have pins which can be inserted or bonded in. The transverse stiffenings prevent unsupported parts of the enclosing element 6 from being pulled in in the region of the cam element 71.

Figure 15:
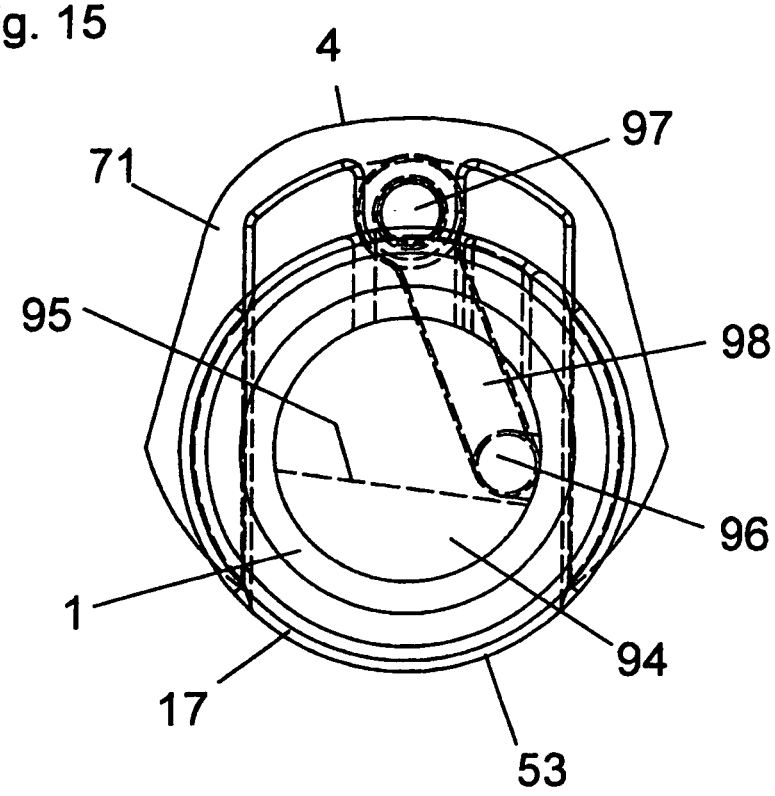
Figure 16:
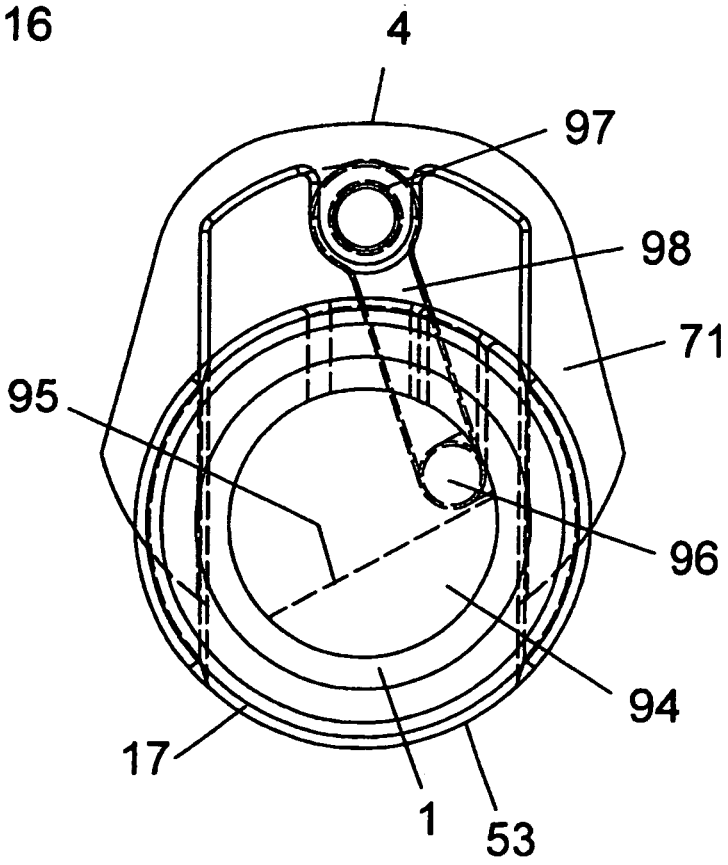

FIGS. 15 and 16 show a variant in which the cam element 71 is extended and retracted under constrained guidance. A control shaft 94 in the interior of the support shaft 1 has a slot 95 in which a guide rod 98 is mounted rotatably on a bearing pin 96. The second end of the guide rod 98 is arranged on a bearing pin 97 which is mounted in the interior of the cam element 71, the cam element 71 being of approximately U-shaped design and being arranged in a manner such that it can be pushed out and in in a guide of the support shaft 1 or in a guide sleeve arranged on the support shaft 1. The constrained guide therefore constitutes a crank mechanism which can be rotated over an angle of approximately 120°. FIG. 15 shows a partial stroke and FIG. 16 shows the full stroke of the cam element 71.

In the variants according to FIGS. 11 to 16, the enclosing element 6 forms on both sides a rectilinear bridging of the transition region between the non-rotatable bearing surface 53 and the eccentric control surface 4, the region changing when the stroke changes.

The enclosing element 6 used in FIGS. 17 to 27 and FIGS. 32 to 34 is extension-resistant, with the result that the particular difference in length between the enclosing length of the control cam region 2 and a circumferential length corresponding at least to the maximum stroke has to be stored.

FIGS. 17 to 21 show a variant similar to FIGS. 1 to 4 with a control rod 64 which can be displaced longitudinally in the support shaft 1 and has, per control cam region 2, a control section 66 which is flattened on both sides and has an obliquely rising longitudinal slot 60. The support shaft 1 is provided in each control cam region 2 with two circumferential ribs 22 between which a guide groove for the cam element 71 is formed, and between which the support shaft 1 is trimmed in some regions. In the apertures 75, which are formed in a manner similar to FIG. 1, the cam element 71, which is of approximately U-shape design, can be moved out of the support shaft 1 and into it, it sliding on the flattened control section 66 in the manner of a rider. A pin 79 passing through the oblique longitudinal slot 60 brings about the constrained guidance of the cam element 71 when the control rod 64 is displaced in both directions. In the central region, the pin 79 is arranged in a slider 62 which slides along the oblique surfaces 67 of the longitudinal slot 60.

In the variants according to FIGS. 17 to 31, the enclosing element 6 is formed in each case by means of a multi-link element, in particular by means of a chain 21, the pivot pins 23 of which connect lateral plates 24 which also bring about the axial guidance on the cam element 71, which engages between the plates 24. In the variants according to FIGS. 17 to 27, the chain 21 constitutes an extension-resistant enclosing element 6 which is protruded to match it to the enclosing length. In this case, one or two pivot pins 23 or rollers 25 can be raised from the circumference of the cam, the plates 24 being raised in each case in a roof-like manner by spring action, as is apparent from the different exemplary embodiments of FIGS. 23 to 27.

The height of the circumferential ribs 22 on the support shaft 1 is selected at least in such a manner that the pivot pins 23 of the rollers 25 bear against the circumferential ribs 22, and the plates 24 engage over the circumferential rib 22 on the outside, so that the chain 21 is secured axially in the control cam region 2.

Figure 17:
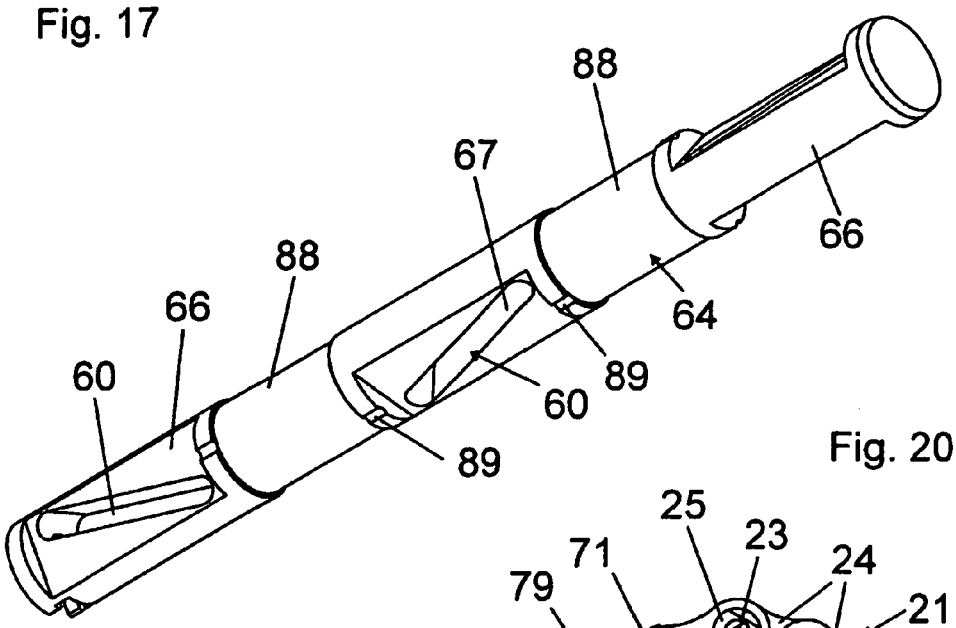
FIG. 17 shows a control shaft of a seventh variant in an oblique view.
Figure 18:
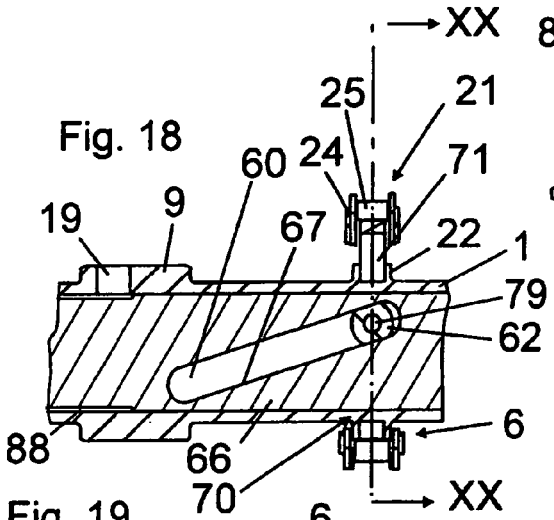
FIGS. 18 and 19 show longitudinal sections through the seventh variant.
Figure 19:
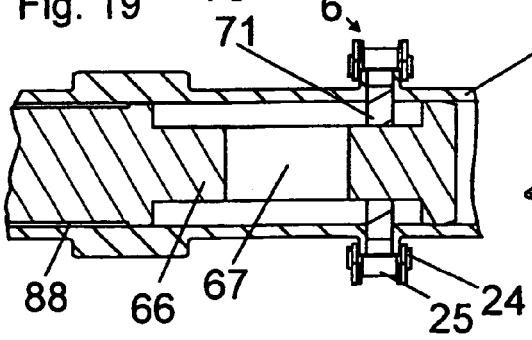
Figure 20:
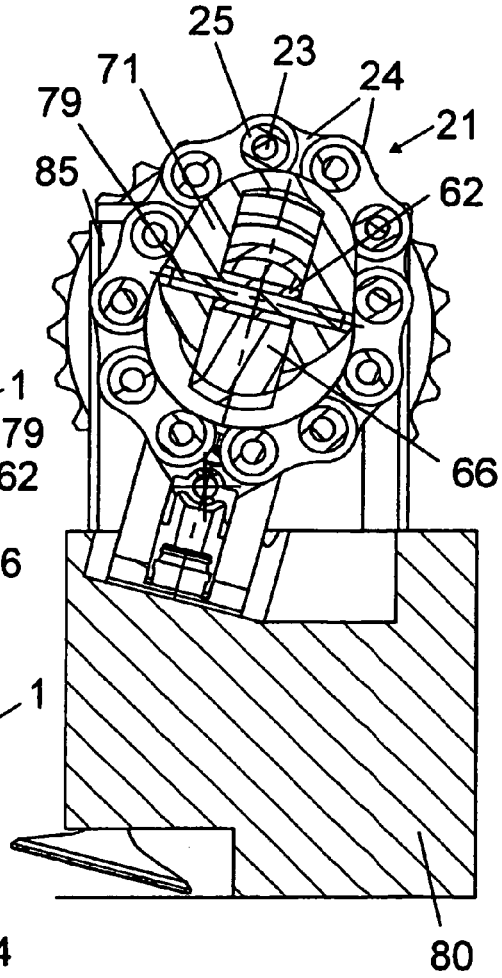
FIG. 20 shows a section through the line XX—XX from FIG. 18.

As FIGS. 17 to 19 show, the support shaft 1 can have inlet holes 19 in the bearing regions 9 for feeding a lubricating medium to the cam element and to the chain links. The associated section of the control rod 64 has a circumferential groove 88, the length of which corresponds at least to the displacement length of the control rod 64, and from which overflow channels 89 lead into the flattened control sections 66. The lubricating medium entering through the holes 19 passes via the circumferential groove 88, the overflow channels 89 and the control section 66 on the one hand into the longitudinal slot 60, to the oblique surfaces 67 thereof, and on the other hand through the apertures 75 between the circumferential ribs 22 and along the outer surfaces of the cam element 71 to the individual chain links which are supplied uniformly with the lubricating medium by the cam element 71 revolving in the chain 21.

As mentioned above, in the case of an extension-resistant enclosing element 6, it is necessary to store the particular excess lengths which, in the case of a chain 21, can take place for example, by making the chain protrude in a suitable region of the circumference. In FIGS. 21 to 24, two spring strips 35 are provided for this, said strips running over a central pivot pin 23 and engaging under the two adjoining pivot pins 23. The spring strips 35 are prestressed in such a manner that they raise the two pivot pins 23 engaged under when the cam element 71 is pulled in. FIG. 22 shows the maximum stroke position in which the chain 21 bears all the way around, and FIG. 23 shows a normal stroke position.

Figure 25:
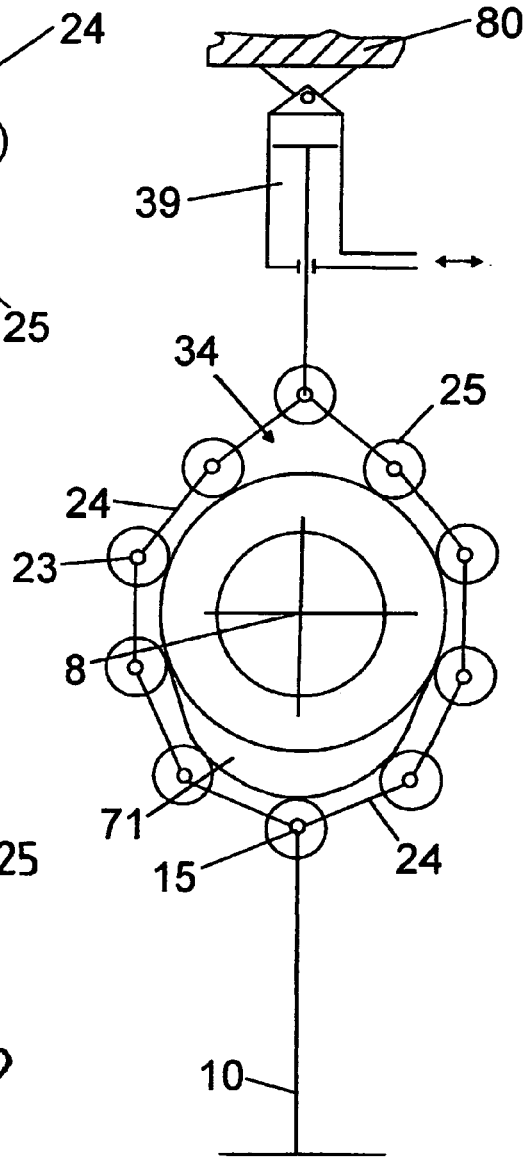
Figure 24:
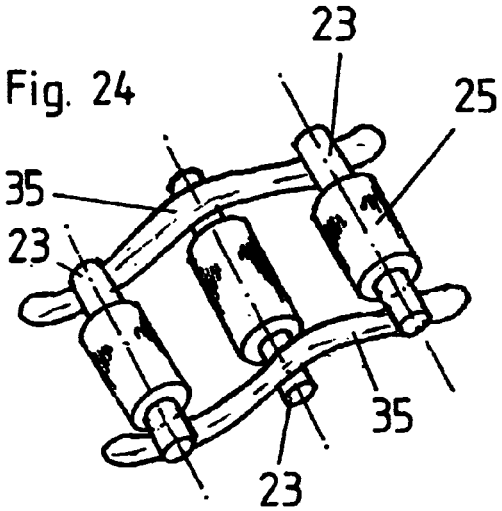
FIG. 24 shows a schematic oblique view of the protuberance spring from FIG. 23, FIGS. 25 to 27 show schematic end views of a ninth, tenth and eleventh variant, in each case in the normal stroke position.
Figure 26:
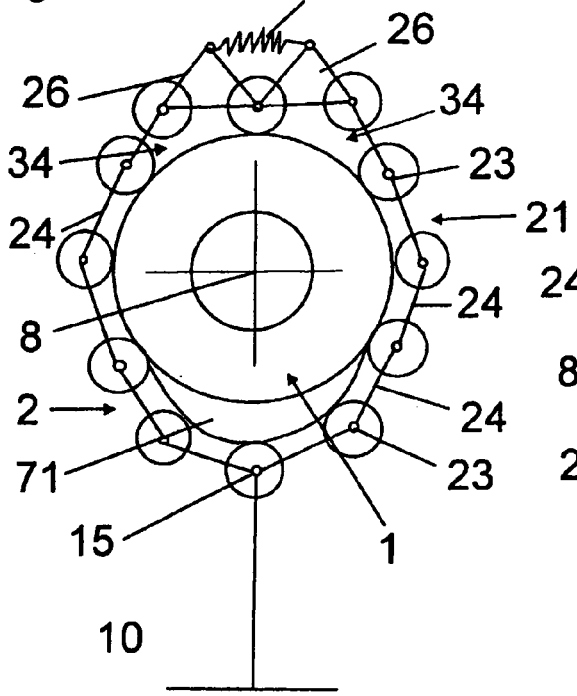
Figure 27:
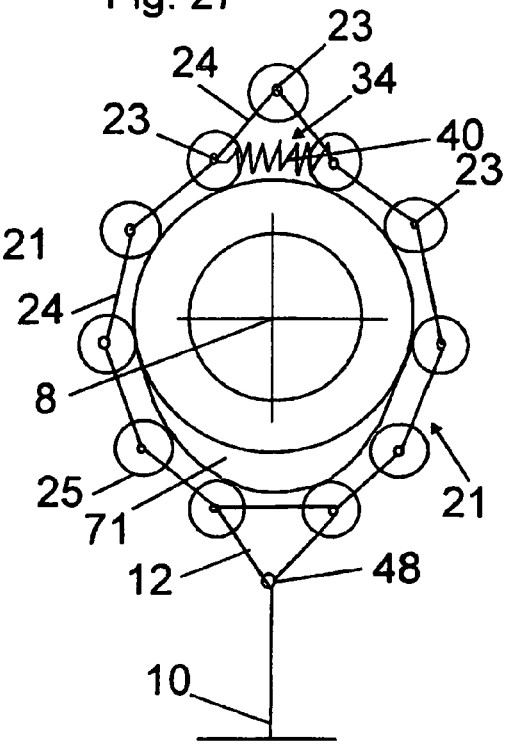
Figure 28:
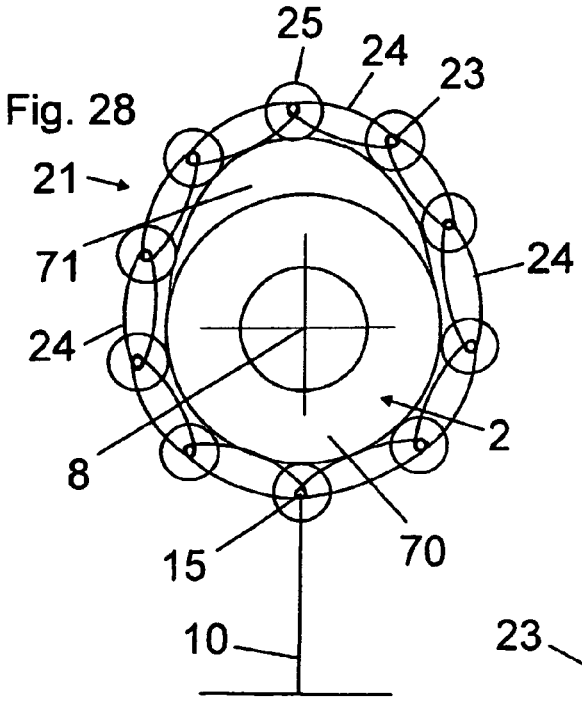
FIG. 28 shows a schematic end view of a twelfth variant in the normal stroke position.

Since, as already mentioned a number of times, the enclosing element 6 does not rotate at the same time, it can also be fitted, as FIG. 25 shows, in a positionally fixed manner on the cylinder block 80 or the like via an actively controllable, hydraulic piston/cylinder unit 39. FIG. 26 shows triangular pivot plates 26, a tension spring 40 which acts upon two protuberances 34 being inserted between the raised ends. In FIG. 27, the tension spring 40 is arranged between a pivot pin 23 and the next but one pivot pin 23, so that a protuberance 34 is formed between these two pivot pins and the central pivot pin 23 is raised. In both variants, the tension spring is stressed further when the cam element 71 is extended into the maximum stroke position. Instead of the tension springs 40, it is also possible in these variants to use hydraulic piston/cylinder units which can be acted upon. In particular in the variant according to FIG. 27, the length of the chain can be matched to the smallest circumferential length of the control cam region 2 by means of a piston/cylinder unit, it also being possible for a piston/cylinder unit of this type to be replaced by a chain link or a pair of plates.

As an alternative, in order to be able to adjust the chain 21 in length, at least one pivot pin 23 can be provided with an eccentric region (not shown), so that the rotation of the pivot pin changes the distance from the next pivot pin 23.

FIGS. 28 to 31 show variants in which the enclosing element 6 is formed as a length-changeable chain 21, the change in length being possible in the plates 24. Of course, pivot pins having adjusting eccentric regions may also be used in this variant.

Figure 29:
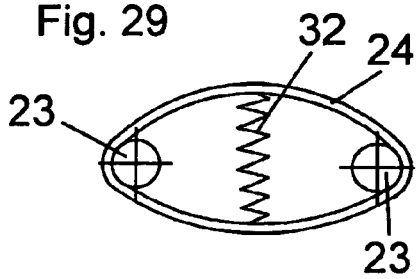
FIG. 29 shows a first design of a link plate of the twelfth variant.

FIG. 29 shows a frame-like plate 24 of a flexible material, which loops around the two pivot pins 23. A spring 32 which spreads the longitudinal sides apart is arranged between the two longitudinal sides. The plates 24 can therefore be stretched during the extension of the circumference, with the result that the chain 21 becomes longer, and becomes shorter when the cam element 71 is pulled in. The spring 32 may be designed as desired, and formed not only by the compression spring (shown schematically), but also by a rubber cushion or the like.

Figure 30:
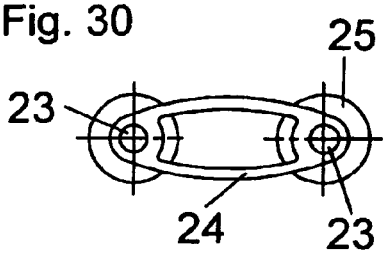
FIGS. 30 and 31 show a second design of the link plate in the normal stroke and in the maximum stroke position.
Figure 31:
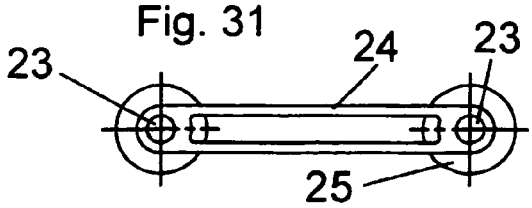

FIGS. 30 and 31 show a frame-like plate 24 of a resilient material, for example spring wire or the like, which is prestressed to shorten the distance between the pivot pins 23 (FIG. 30). When the cam element 71 is transferred into the maximum stroke position, each plate 24 is stretched into the end position shown in FIG. 31. The plates 24 may also be cast into a gummy material or vulcanized onto it.

FIGS. 17 to 20 and 23 to 31 in each case show rollers 25 which are mounted on the pivot pins 23. The rollers may be produced, for example, from a highly wear-resistant, low-friction ceramic, for example of silicon nitride ($Si_3N_4$). Instead of the rollers 25, sliding bodies may also be provided.

Figure 21:
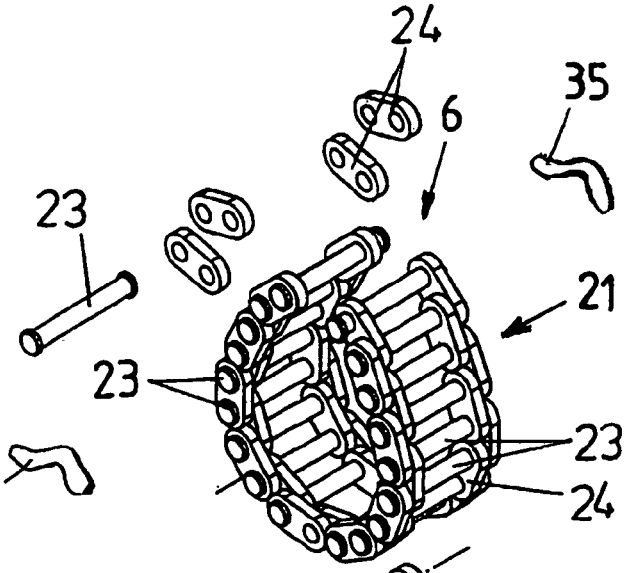
FIG. 21 shows parts of an eighth variant in an oblique view.
Figure 22:
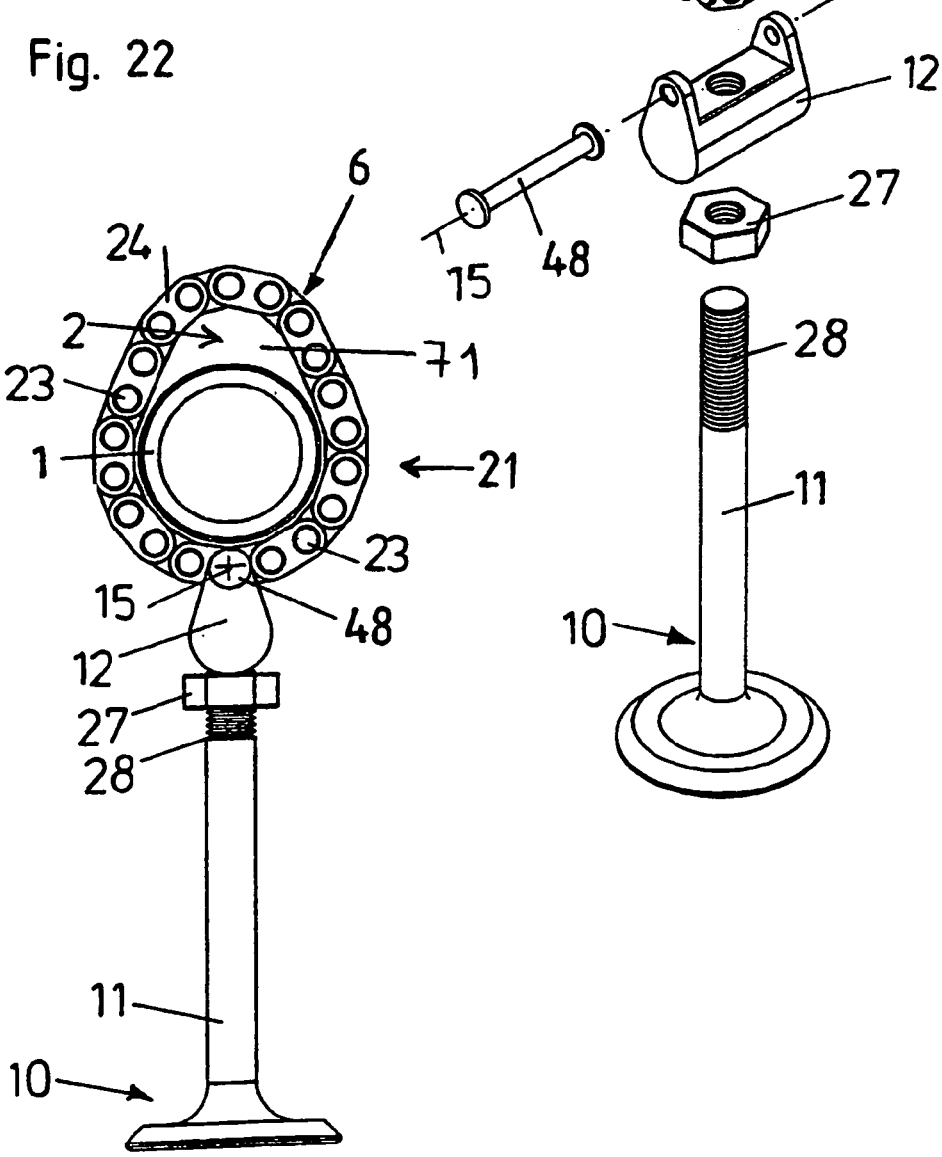
FIG. 22 shows an end view of the eighth variant in the maximum stroke position.
Figure 23:
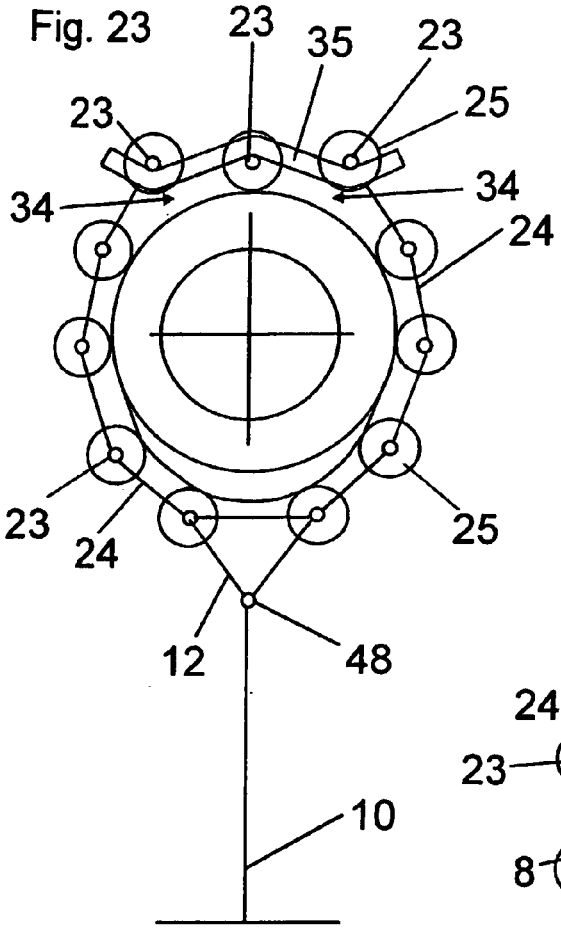
FIG. 23 shows a schematic end view of the eighth variant in the normal stroke position.

In the variant according to FIGS. 21 and 22, a pivot pin is extended and forms the bearing pin 48 for the fork-shaped holder 12 of the cam follower element 10, into which the valve stem 11, which is provided with a thread 28, is screwed in an adjustable manner and is fastened by the counter nut 27. In the schematic illustration according to FIGS. 23 and 27, the holder 12 is formed by a triangular axis of articulation, in which the cam follower element is coupled to an additional bearing pin 48.

The enclosing element shown in FIGS. 32 to 34 is again extension-resistant and is designed as a band or the like.

Figure 32:
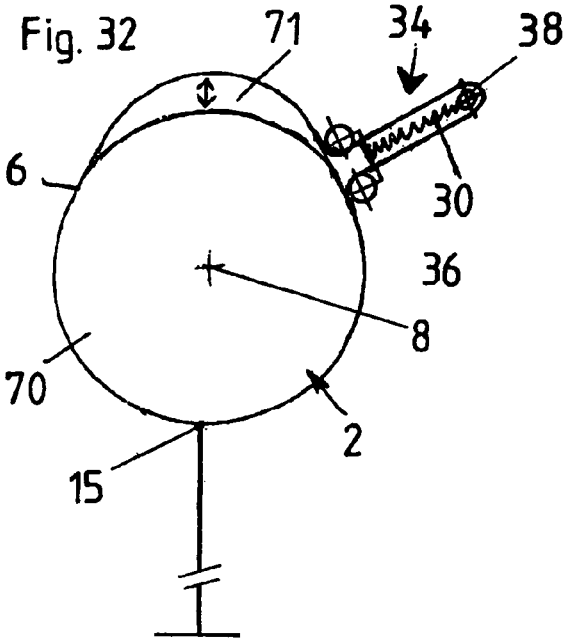
FIG. 32 shows a schematic illustration of a thirteenth variant.

FIG. 32 shows a schematic possibility for storing the band by the excess length being guided in the form of a protuberance 34 via two deflecting rollers 36, which are parallel to each other and are kept at a distance, and via a deflecting roller 38 which is pressed outward, for example by means of a spring 30, a hydraulic piston/cylinder or the like. When the circumferential length is enlarged by the cam element 71 being extended or pivoted, part of the enclosing element 6 is pulled in from the protuberance 34, as a result of which the spring 30 is more strongly compressed. On return into the normal stroke or even zero stroke position, the spring 30 presses the deflecting roller 38 further outward again.

Figure 33:
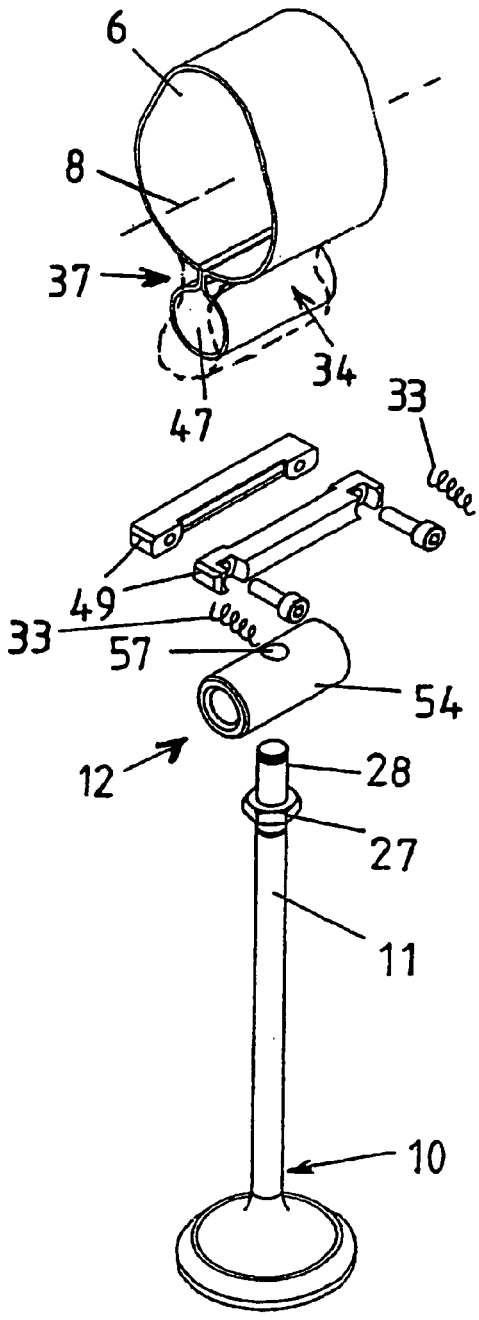
FIG. 33 shows parts of a fourteenth variant in an oblique view.
Figure 34:
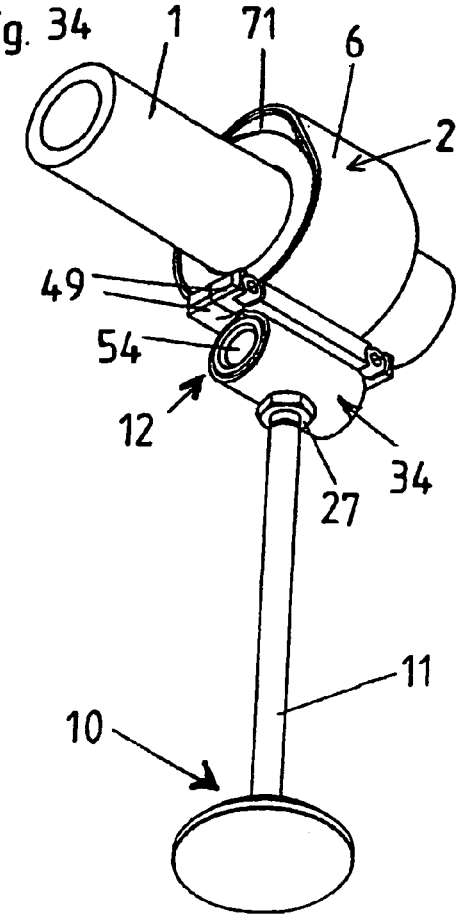
FIG. 34 shows an oblique view of the fourteenth variant in the normal stroke position.

FIGS. 33 and 34 show a variant in which the protuberance 34 has a constriction 37 of the enclosing element 6, which constriction is of elastically flexible design. The solid lines of the enclosing element 6 show the normal stroke position. The maximum stroke position is shown by dashed lines with the constriction 37 expanded, the eyelet 47 which holds the holder 12 being spaced further away from the axis of rotation 8 in this position.

The insert 54 which is inserted into the protuberance 34 has a latching or threaded hole 57 into which that end of the valve stem 11 which is latchable or is provided with a thread 28 can be inserted or screwed. In the latter case, a counter nut 27 serves to set or fix the length of the cam follower element 10. The forces acting when the cam part 71 is pushed out expand the constriction 37, the regions of which that are in contact with each other being moved away from each other. The constriction 37 is brought about by two clamping jaws 49 which can be braced against each other by means of springs 33. The two clamping jaws 49 may also be of identical design, with the result that one connecting screw in each case is inserted into a clamping jaw 49. If appropriate, the prestressing of the springs 33 may also be settable.

Instead of the clamping jaws 49, a latchable, elastically expandable constricting device is also conceivable by, for example, two identically designed parts which are provided with latching hooks and latching openings being clipped to each other.

In order to minimize tolerances, it is advantageous, in particular in the production of the valve timing gears for internal combustion engines, if the cam shaft is ground after assembly. In this case, grinding dust penetrates all of the cavities and has to be removed. The dismantling and reassembly after grinding is, on the one hand, very complex and, on the other hand, leads again to small inaccuracies. Use may be made here of the lubricant feed paths described with reference to FIGS. 17 to 20 in order to prevent the grinding dust from penetrating the interior. This takes place by the cam shaft being rinsed during the grinding process with a liquid under pressure, the liquid entering via the inlet holes 19 and emerging again at all outlet possibilities present. In particular, the grinding liquid used for the grinding is suitable for this.

I claim:

1. A device for converting a rotational movement into a reciprocating movement, comprising:

a support shaft with at least one control cam region;

a rotatably driven cam element disposed in each said control cam region, said cam element having an eccentric control surface;

a cam follower element displaceable by said cam element;

a flexible enclosing element connecting said cam element and said cam follower element and biasing said cam follower element to follow said control surface of said cam element;

said enclosing element having an enclosing length and said control surface having a circumferential length, and wherein said enclosing length and said circumferential length are variable in correspondence with one another.

2. The device according to claim 1, wherein the circumference of said control cam region is configured to be variably changed in correspondence with said enclosing length of said enclosing element.

3. The device according to claim 1, wherein said enclosing length of said enclosing element is variable and can be matched to a particular said circumferential length.

4. The device according to claim 1, wherein said cam element is disposed on said support shaft for translational movement in a radial plane.

5. The device according to claim 4, which comprises a control rod longitudinally displaceable in said support shaft, said control rod having an oblique surface, and said cam element is formed with an oblique surface disposed to interact with said oblique surface of said control rod.

6. The device according to claim 4, which comprises a control shaft rotatably disposed in said support shaft and having a spiral control surface, said cam element having a web disposed to interact with said spiral control surface of said control shaft.

7. The device according to claim 4, which comprises a control shaft rotatably disposed in said support shaft, and a crank drive connected to said control shaft for moving said cam element in and out.

8. The device according to claim 4, which comprises a control shaft rotatably disposed in said support shaft, and wherein said cam element is pivotally disposed about an axis parallel to an axis of rotation of said support shaft and is formed with a guide surface which interacts with a crank pin of said control shaft.

9. The device according to claim 4, wherein said support shaft is mounted longitudinally displaceable in at least two bearing elements and is formed with an oblique surface interacting with an oblique surface of said cam element, and said cam element is disposed so as not to be axially displaceable.

10. The device according to claim 4, wherein said cam element is guided in a constrained guide.

11. The device according to claim 1, wherein said support shaft and said cam element are formed with channels for feeding a friction-reducing medium to said eccentric control surface.

12. The device according to claim 1, wherein said enclosing element is formed from an extension-resistant material and has a circumferential length corresponding to a maximum circumferential length of said control cam region, and wherein a difference length between said enclosing length and said circumferential length of said enclosing element is arranged in at least one variable protuberance.

13. The device according to claim 12, wherein said protuberance is elastically flexible.

14. The device according to claim 13, which comprises a spring disposed to act upon said protuberance.

15. The device according to claim 14, which comprises two pivot pins, and wherein said spring or said piston/cylinder unit acts between said two pivot pins.

16. The device according to claim 15, wherein one pivot pin protrudes on both sides and forms a bearing pin for a holder of said cam follower element.

17. The device according to claim 12, wherein said protuberance is provided with an elastically flexible constriction.

18. The device according to claim 12, which comprises a driven piston/cylinder unit for varying said protuberance.

19. The device according to claim 12, wherein said enclosing element includes mutually articulated link elements.

20. The device according to claim 12, wherein said enclosing element is a chain.

21. The device according to claim 1, wherein said enclosing element is formed with parts of different materials, and at least one material has a variable length.

22. The device according to claim 21, wherein said enclosing element is elastically extensible.

23. The device according to claim 21, wherein said enclosing element is a chain, and said chain has elastically flexible plates.

24. The device according to claim 23, wherein said plates are frame-shaped plates.

25. The device according to claim 24, which comprises a spring element between opposite longitudinal sides of each said frame-shaped plate.

26. The device according to claim 23, wherein said plate is formed of a spring wire.

27. The device according to claim 1, wherein said enclosing element consists of an elastically extensible material.

28. The device according to claim 27, wherein said enclosing element has a band of textile-bonded sheet material.

29. The device according to claim 27, wherein said elastically extensible material has a defined extension limit.

30. The device according to claim 1, wherein said flexible enclosing element surrounds said eccentric control surface of said driven cam element and a non-driven bearing surface for said cam follower element.

31. The device according to claim 30, wherein said non-driven bearing surface is formed on an annular end region of a bearing element on which at least one of said support shaft and said cam element is rotatably mounted.

32. The device according to claim 30, which comprises a rolling bearing between said bearing element and one of said support shaft and said cam element.

33. The device according to claim 1, wherein said enclosing element is movably connected to said cam follower element in a plane perpendicular to the axis of rotation of said cam element.

34. The device according to claim 33, wherein said cam follower element has an end connected to said enclosing element and guided in a guide fixed on the device.

35. The device according to claim 33, which comprises a bearing pin coupling said cam follower element to said enclosing element, and wherein said bearing pin is pressed against a bearing surface fixed on the device by an elastic element formed of an elastic material selected from the group consisting of steel and rubber.

36. In an internal combustion engine of a motor vehicle, the device according to claim 1 configured as a cam control, of a valve timing gear.

37. The device according to claim 36, wherein said cam follower element is a valve tappet.

* * * * *